US005861633A

United States Patent [19]

Mandellos

[11] Patent Number: 5,861,633

[45] Date of Patent: Jan. 19, 1999

[54] IRRADIATOR APPARATUS

[75] Inventor: Panagiotis Mandellos, Glencoe, Ill.

[73] Assignee: Con-Trol-Cure, Inc., Chicago, Ill.

[21] Appl. No.: 905,181

[22] Filed: Aug. 4, 1997

[51] Int. Cl.[6] ..... H05B 31/04

[52] U.S. Cl. ..... 250/504 R; 250/493.1

[58] Field of Search ..... 250/504 R, 493.1, 250/494.1, 495.1; 362/217, 218, 225; 355/66, 67

[56] References Cited

U.S. PATENT DOCUMENTS

| | | | |
|---|---|---|---|
| 3,819,929 | 6/1974 | Newman | 250/504 R |
| 3,831,289 | 8/1974 | Knight | 34/4 |
| 3,872,349 | 3/1975 | Spero et al. | 315/39 |
| 3,983,039 | 9/1976 | Eastland | 250/492 R |
| 4,507,587 | 3/1985 | Wood et al. | 315/39 |
| 4,532,427 | 7/1985 | Matthews et al. | 250/492.2 |
| 4,665,627 | 5/1987 | Wilde et al. | 34/4 |
| 4,710,638 | 12/1987 | Wood | 250/492.1 |
| 5,049,725 | 9/1991 | Abramson | 219/347 |
| 5,426,308 | 6/1995 | Sudduth et al. | 250/504 H |
| 5,440,137 | 8/1995 | Sowers | 250/504 R |

OTHER PUBLICATIONS

Selected pages from 1994 product catalog of UV Process Supply, Inc., Chicago, Illinois

*Primary Examiner*—Kiet T. Nguyen
*Attorney, Agent, or Firm*—Thomas W. Tolpin; Richard L. Wood

[57] ABSTRACT

An irradiator includes an elongated housing having an interior recess opening outwardly along a longitudinal length of the housing. A plurality of generally planar relatively thin ribs are supported within the recess substantially transverse to the longitudinal axis of the housing and define laterally spaced substantially symmetrical contour surfaces operative to support reflector members. The ribs are readily interchangeable to support reflector members so as to establish generally parabolic, semi-circular or elliptical reflector profiles. A pair of lamp holder assemblies are supported within the housing recess for supporting a source of light energy, such as an elongated ultraviolet light bulb, intermediate the contour surfaces to enable focused or nonfocused irradiation of energy. In one embodiment, shutters as provided to substantially preclude irradiation when in closed positions.

28 Claims, 5 Drawing Sheets

IRRADIATOR APPARATUS

BACKGROUND OF THE INVENTION

The present invention relates generally to light energy irradiators, and more particularly to an irradiator having novel structural components that provide improved cooling of light energy reflector surfaces without diminishing the efficiency of the light energy source and which enable relatively inexpensive manufacture of custom sizes for various applications.

Light energy irradiators for obtaining relatively intense energy radiation are well known and find many applications in research, manufacturing and the medical field. For example, researchers, test engineers and production engineers use ultraviolet ("UV") irradiators in such diverse applications as curing of photopolymer paints, inks and coatings; photoactivation of UV sensitive adhesives; photoresist activation; and graphic arts exposure, etc. Light energy irradiators find application in the dental field for curing polymers and the like. Typically, the known irradiators utilize a light energy source, such as a fluorescent or mercury vapor lamp, or a cal rod, designed to produce light energy radiation in the 185–1200 nanometer range. The light energy source is conventionally supported adjacent a reflector surface operative to provide either a focused or nonfocused optical configuration. For example, when used for curing, a reflector system having an elliptical profile reflector surface provides a focused optical configuration wherein the light energy is concentrated into a narrow beam on the curing surface. Elliptical reflector systems find particular application in curing fast moving films such as printing inks carried on a conveyor.

A reflector system having a semi-circular or parabolic profile reflector surface provides a nonfocused optical configuration wherein the light energy acts over a relatively wide area. This optical configuration permits one or more irradiators to be positioned either across or parallel to the direction of movement of a curing surface for greater exposure time, and finds particular application in curing thicker, slow-moving films such as sensitive adhesives.

In utilizing irradiators having either focused or nonfocused optical configurations, many applications require a custom size irradiator. Irradiators are known that employ extruded aluminum housings having parabolic or elliptical reflector surfaces formed integrally on the housing, such as a polished reflector surface, or having concave parabolic or elliptical support surfaces formed on the housing and on which are mounted reflector sheets, such as polished aluminum, to provide the desired optical reflector configuration. A significant problem with prior irradiators having optically polished reflector surfaces formed either integrally on an extruded aluminum housing or defined by mounted reflector sheets is that the reflector surfaces deteriorate over time and are difficult and expensive to replace. Prior irradiators have also employed quartz housings having integral concave elliptical or parabolic light energy reflector surfaces formed thereon. A coating may be put on either the quartz or aluminum reflector surfaces so that only selected wavelengths are reflected, with the non-reflected wavelengths being absorbed by the quartz or aluminum housing. This can result in similar heat problems as the quartz and aluminum housings become heated by the non-reflected wavelengths.

In manufacturing prior light energy irradiators, it has been a conventional practice to make a number of different size housings for use in standard size irradiators. If a custom size is required, that is, a size other than a standard production size, the various components must be specially made. This is a time consuming process and relatively expensive. Thus, a light energy irradiator that can be readily custom made to different length sizes and reflector surface configurations at relatively low cost and which overcomes the heat problems experienced with prior irradiators would provide substantial economic and operational advantages over the prior known light energy irradiators.

SUMMARY OF THE INVENTION

One of the primary objects of the present invention is to provide an irradiator having a novel construction that provides improved cooling of light energy reflector surfaces without diminishing the efficiency of the light energy source and which enables custom sizing without the need for specially sized relatively expensive components requiring time consuming assembly.

A more particular object of the present invention is to provide an irradiator employing a novel housing adapted to receive and support rib members in selective spaced parallel relation along the length of the housing, and wherein the rib members are adapted to support relatively thin metallic reflector members to provide focused or nonfocused radiation from a light energy source extending lengthwise of the housing between the reflector members, the rib members being configured to facilitate air circulation along opposite surfaces of the reflector members so as to effect rapid heat transfer without adversely affecting the light energy source.

A further object of the invention is to provide a novel irradiator having an elongated housing defining a longitudinal recess or cavity in which are supported a plurality of relatively thin metallic ribs having high heat transfer characteristics and having mutually opposed contour surfaces thereon. The ribs have mounting tabs thereon adapted to be selectively secured to the housing so that the ribs are disposed in parallel, axially aligned, spaced relation. The rib contour surfaces enable mounting of relatively thin metallic reflector members against the contour surfaces to establish elliptical or parabolic reflector surfaces for effecting radiation from a light energy source, such as a UV lamp, supported between and parallel to the reflector members.

A feature of the irradiator in accordance with the invention lies in the provision of an extruded housing having longitudinal slots extending substantially the full length thereof so as to enable profiled ribs, end plates and lamp holders to be readily mounted on the housing in selectively spaced relation along the length of the housing to accommodate different size lamps within the same housing.

Another feature of the irradiator in accordance with the invention lies in the ability to readily adapt the irradiator for focused and non-focused irradiation of light energy through simple interchanging of ribs having elliptical or parabolic profile contour surfaces thereon to receive reflector plates in similar contour configurations.

Another feature of the irradiator in accordance with the present invention lies in the ease of adapting the irradiator for shuttered or non-shuttered operation, the shutters being operative to substantially prevent energy radiation when in closed positions.

Still another feature of the irradiator in accordance with the invention lies in the provision of relatively thin generally planar ribs adapted for selective mounting in aligned relation along the length of the support housing, each rib having a pair of laterally spaced generally symmetrical leg portions having contour edge surfaces defining either elliptical or parabolic edge profiles that terminate at a recess configured to receive a marginal edge of a reflector member when disposed against the corresponding profile edge surface. Each rib includes a pair of reflector mounting ears adapted to releasably support a further light energy reflector member intermediate the profiled reflectors so as to establish air gaps between the reflector members to enable cooling air to pass over opposite surfaces of the profiled reflector members without adversely cooling a light energy source supported between the contoured reflector members.

Yet another feature of the invention lies in the use of relatively thin aluminum reflector members supported by the ribs so as to define light energy reflecting surfaces and which enable rapid heat transfer by passage of air over opposite surfaces of the reflector members so as to allow optimum use of dichroic coatings on the reflector surfaces.

Another feature of the invention lies in the provision of a light energy source support arrangement that enables end support of elongated lamps having either ceramic or metallic ends.

Further objects, features and advantages of the invention, together with the organization and manner of operation thereof, will become apparent from the following detailed description when taken in conjunction with the accompanying drawings wherein like reference numerals designate like elements throughout the several views.

DETAILED DESCRIPTION

Figure 1:
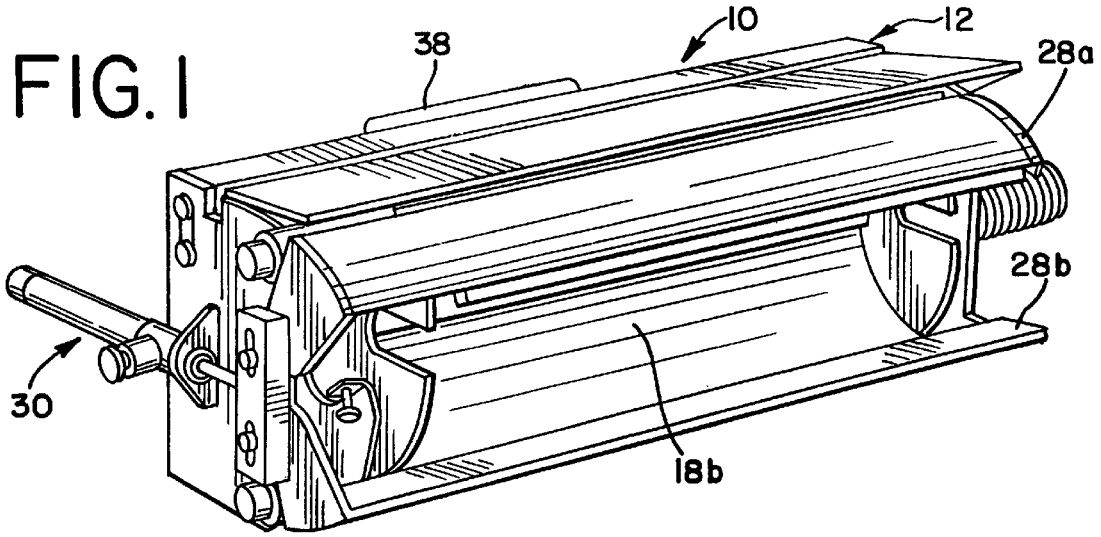
FIG. 1 is a perspective view of an irradiator constructed in accordance with an embodiment of the present invention that employs shutters, the light energy lamp being removed for clarity and the shutters being shown in open positions.
Figure 2:
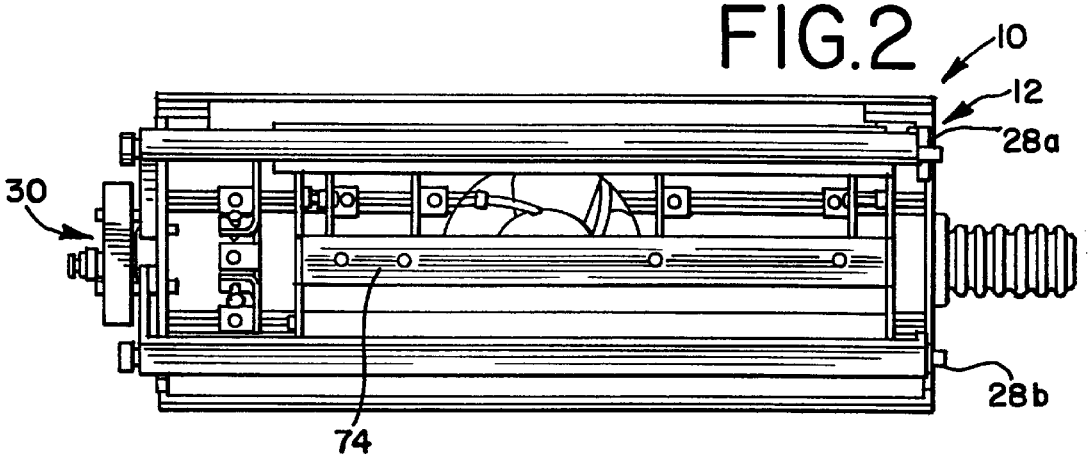
FIG. 2 is an elevational view of the irradiator of FIG. 1 but with the shutters open and with the light energy lamp and one of the reflector members removed for purposes of clarity.

Referring now to the drawings, an in particular to FIGS. 1 and 2, an irradiator apparatus constructed in accordance with one embodiment of the present invention for irradiating light energy is indicated generally at 10. As will be described, the irradiator apparatus 10, which may hereafter be referred to simply as the irradiator, provides improved cooling of light energy reflectors without adversely affecting the light energy lamp source, and also lends itself to economic production and assembly and to interchangeability of parts to enable focused or nonfocused optical radiation of light energy, depending upon the intended application or use of the irradiator.

Briefly, the irradiator 10 includes an elongated housing, indicated generally at 12, which defines an internal recess 14 opening outwardly along a longitudinal length of the housing. Rib means in the form of a plurality of generally planar ribs 16 are releasably mounted within the recess 14 such that each rib is disposed generally transverse to the longitudinal axis of the housing 12. As will be described, each of the ribs 16 has a pair of laterally spaced contour surfaces adapted to receive and support reflector members, indicated at 18*a* and 18*b*, so that the reflector members lie on opposite sides of and are generally symmetrical relative to a median plane perpendicular to an exterior surface 12*a* of the housing and containing the longitudinal axis of the recess 14. The ribs 16 may have elliptical, semi-circular or parabolic profile surfaces formed thereon so that the reflector members 18*a* and 18*b* are of similar transverse profile when mounted against the profile surfaces on the ribs, thereby enabling focused or nonfocused optical configurations of energy reflected from a light energy source.

In the embodiment illustrated in FIGS. 1–4, a pair of generally planar light energy lamp support plates 22*a* and 22*b* are supported within the housing recess 14 so as to lie in parallel axially aligned relation with the ribs 16. The lamp support plates 22*a* and 22*b* are adapted to support a conventional light energy source, such as a suitable fluorescent or mercury vapor lamp or a calrod, so that the light energy source is capable of emitting light energy in the range of approximately 185–1200 nanometers, and preferably at least 300–600 watts per linear inch. The illustrated lamp support plates 22*a* and 22*b* are particularly adapted for supporting opposite ends of an elongated ultraviolet ("UV") lamp so as to enable adjustment of the lamp to effect a desired focal point when employing elliptical profile reflector members to effect focused irradiation.

Figure 11:
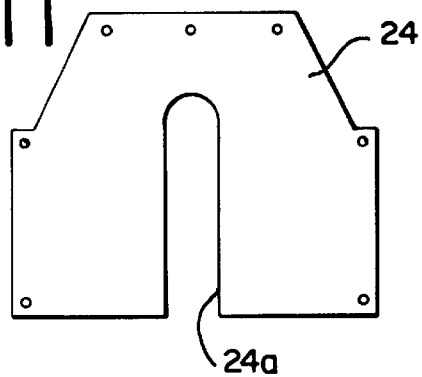
FIG. 11 illustrates a blank of a reflector plate as may be utilized in the assembly of FIG. 7.

Preferably, a pair of generally planar reflector plates, one of which is indicated at 24 in FIG. 11, are also supported by the housing 12 within the recess 14. Each reflector plate 24 is interposed between one of the lamp support plates 22*a* or 22*b* and the next adjacent rib 16 so as to assist in reflecting maximum energy from the irradiator 10.

In the embodiment of the irradiator 10 illustrated in FIGS. 1 and 2, a pair of shutters 28*a* and 28*b* are hingedly supported by the housing 12 and are movable through actuator means in the form of a double acting cylinder arrangement, indicated generally at 30, between open positions, as illustrated in FIGS. 1 and 2, enabling full irradiation, and closed positions wherein the shutters substantially prevent irradiation. For example, when the irradiator is used for curing or drying products carried on a conveyor, sensor means operative to sense movement of the conveyor may cooperate with the actuator cylinder 30 to close the shutters 28*a,b* in response to stopping of the conveyor.

Figure 3:
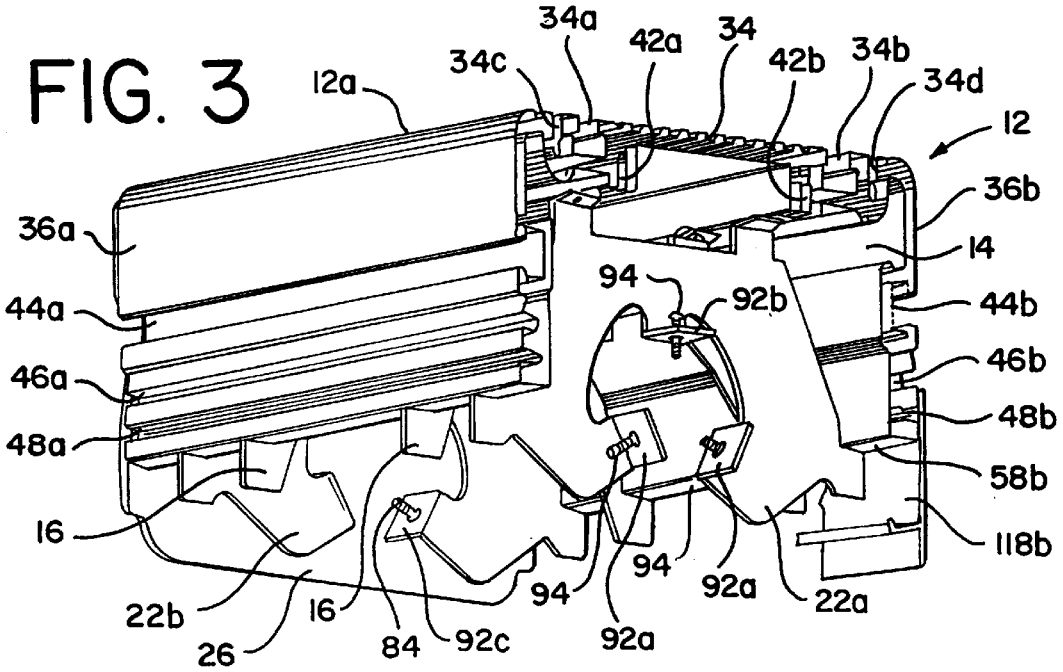
FIG. 3 is a perspective view showing a length of housing as employed in the irradiator of FIG. 1 having pairs of ribs and lamp holder plates mounted within a recess in the housing and having an end plate secured to the far end of the housing, the forward end plate and reflector members being removed for clarity.
Figure 6:
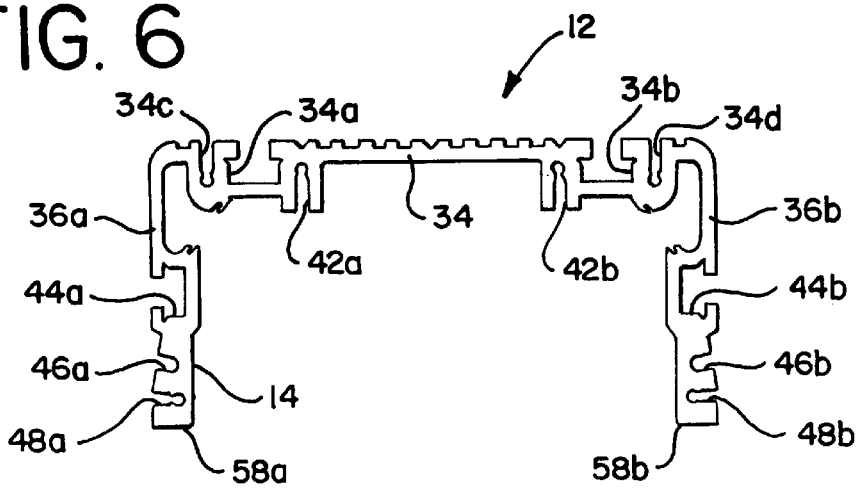
FIG. 6 is an end view of the housing of FIG. 3.

Turning now to a more detailed description of the irradiator apparatus 10, and referring to FIGS. 3 and 6, the housing 12 may be made of extruded aluminum and includes a base wall 34 and a pair of laterally spaced side walls 36*a* and 36*b*, as best seen in FIG. 6. In the illustrated embodiment, the side walls 36*a,b* are formed integral with and at generally right angles to the base wall 34. The base wall 34 has a pair of outwardly facing longitudinal channels 34*a* and 34*b* that facilitate mounting of the housing, and thereby the irradiator 10, to an external support fixture (not shown). The base wall 34 also has a pair of outwardly facing longitudinal slots 34*c* and 34*d* which serve as screw mounting slots to facilitate mounting of external accessories to the base wall, such as a ventilation fan as indicated at 38 in FIG. 1. A pair of laterally spaced longitudinal screw mounting slots 42*a* and 42*b* are formed in the housing base wall 34 to intersect the recess 14 and facilitate mounting of the ribs 16, lamp support plates 22 and reflector plates 24 internally of the recess 14.

The laterally spaced side walls 36*a* and 36*b* are mirror images of each other and have outwardly facing longitudinal channels 44*a* and 44*b*, respectively, formed therein similar to the channels 34*a,b* to provide an alternative means for securing the housing 12 to an external support. Each of the side walls 36*a,b* also has an outwardly facing longitudinal locator channel, as indicated at 46*a* and 46*b*, respectively, and a longitudinal screw mounting slot, as indicated at 48*a,b*, respectively, formed therein.

Figure 4:
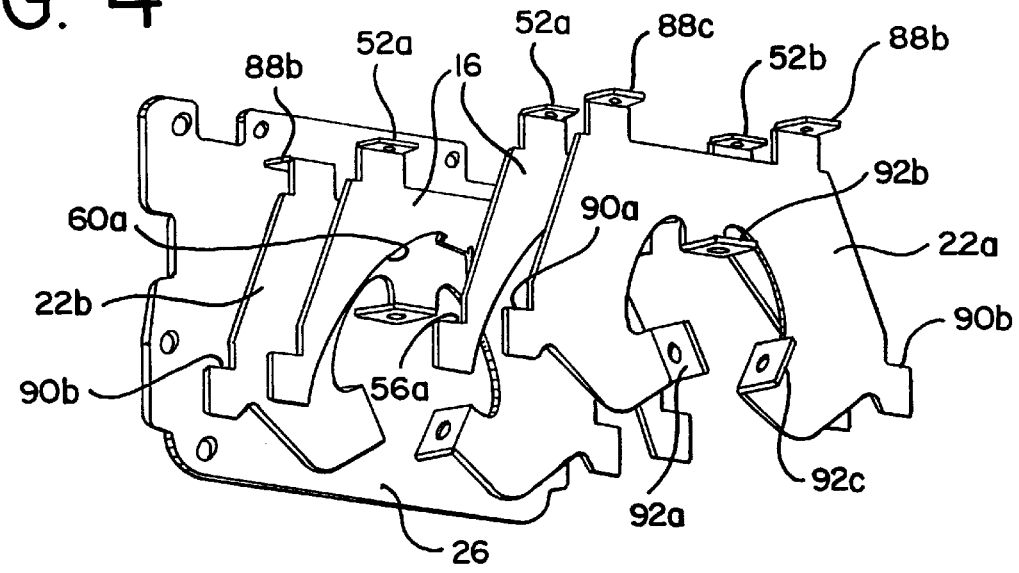
FIG. 4 is a perspective view of the ribs, lamp holder plates and end plate as shown in FIG. 3 but with the housing removed.
Figure 10:
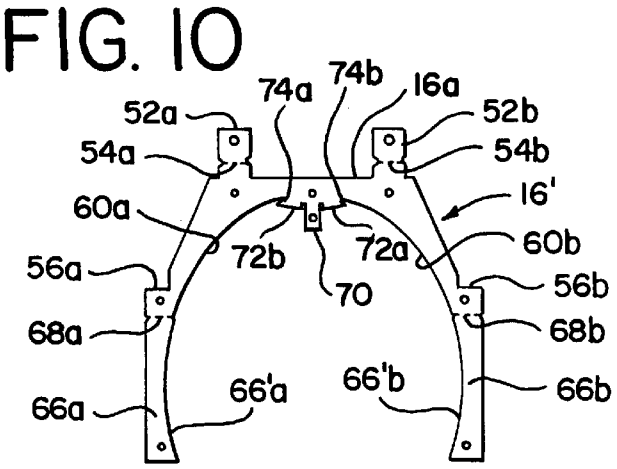
FIG. 10 is a detail view of one embodiment of a rib blank employed to form an elliptical profile rib as utilized in the assembly of FIG. 7.

Referring to FIGS. 3 and 4, taken in conjunction with FIG. 10, the ribs 16 are preferably made of relatively thin metallic material, such as 1/16 inch stainless steel. The ribs 16 may be made from generally planar metallic blanks, as indicated at 16' in FIG. 10, to accommodate use with both irradiators having hinged shutters, as illustrated in FIGS. 1 and 2, and irradiators that do not employ shutters. As shown in FIG. 10, the rib blank 16' has a pair of mounting tabs 52*a* and 52*b* that may be bent about bend lines 54*a* and 54*b*, respectively, to form 90° mounting tabs for mounting the rib within the housing recess 14 by screw attachment to the screw mounting slots 42*a,b*. Right angle recesses 56*a* and 56*b* are formed on rib blank 16' to abut corner edges 58*a* and 58*b*, respectively, on the side walls 36*a* and 36*b* of housing 12.

The rib blanks 16' are formed with laterally opposed contour edge surfaces 60*a* and 60*b* that are symmetrical about a median plane perpendicular to edge 16*a* of the rib blank. In accordance with one feature of the invention, ribs 16 having different shape or profile contour edge surfaces, such as elliptical, parabolic or semi-circular shaped contour edges, may be formed and are readily interchangeable within the housing recess 14 depending on whether focused or nonfocused optical configurations of radiated light energy are desired.

Figure 8:
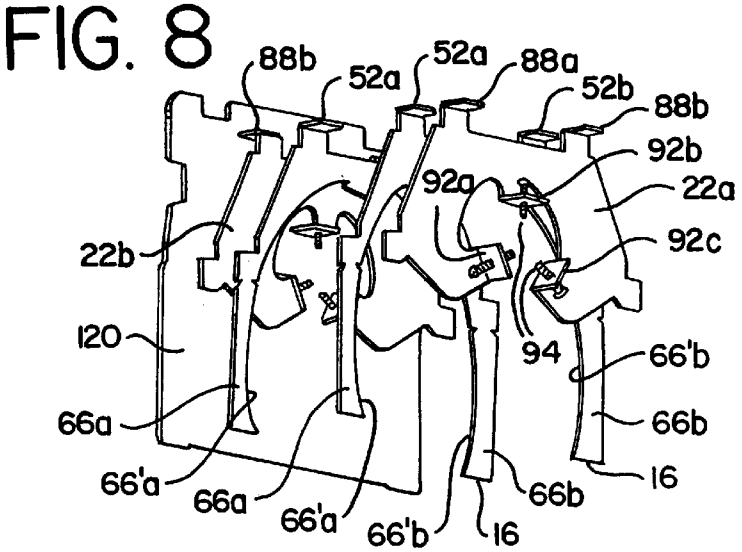
FIG. 8 is a perspective view of the ribs, lamp holder plates and end plate employed in the assembly of FIG. 7.
Figure 7:
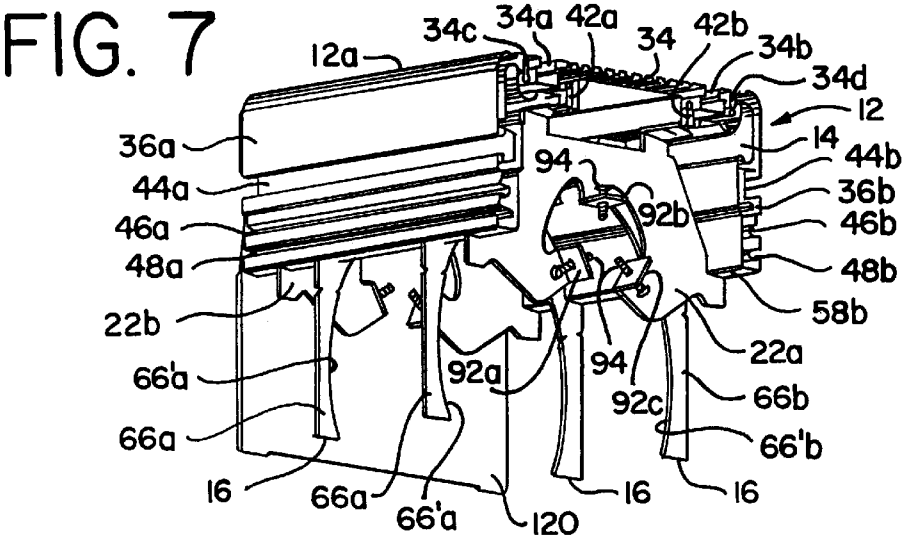
FIG. 7 is a perspective view similar to FIG. 3 but illustrating a housing having pairs of ribs and lamp holder plates and a single end plate mounted thereon in accordance with a non-shuttered embodiment of the irradiator.

The rib blank 16' has elongated lower leg portions 66*a* and 66*b* having inner mutually opposed contour surfaces 66'*a* and 66'*b* corresponding to and forming extensions of the parabolic, elliptical or semi-circular profile of their respective upper contour surfaces 60*a* and 60*b*. The lower leg portions 66*a,b* are adapted to be severed at fracture lines 68*a* and 68*b*, respectively, to provide ribs 16 for use in the irradiator 10 having shutters 28*a,b* thereon. When employed with an irradiator that does not employ shutters, the leg portions 66*a* and 66*b* are retained on the ribs 16, as illustrated in FIGS. 7 and 8.

Figure 9:
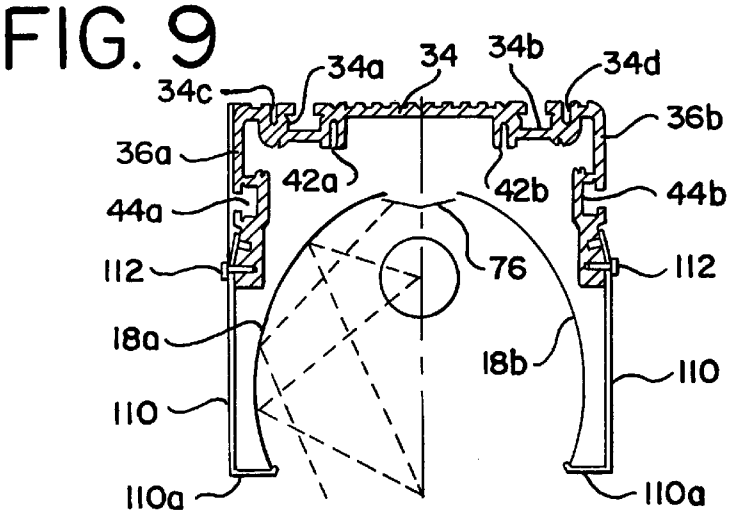
FIG. 9 is a transverse sectional view of the housing of FIG. 7 but having light guard plates mounted on the housing and showing the manner of mounting reflector plates within the housing on the support ribs.

As shown in FIG. 10, the rib blank 16' has a mounting tab 70 formed thereon intermediate a pair of angled edge surfaces 72*a* and 72*b*. The angled edge surfaces 72*a,b* are configured to form recesses 74*a* and 74*b* between the edge surfaces 72*a,b* and the contour edge surfaces 60*a* and 60*b*. In use, the mounting tab 70 is bent to a 90° angle relative to the plane of the rib blank to facilitate mounting of an elongated relatively narrow shallow V-shaped reflector member 76 against the edge surfaces 72*a,b* within the housing recess 14, as shown in FIG. 9. The reflector member 76 may be made of a thin aluminum having a polished reflector surface exposed to the recess 14.

The reflector member support ribs 16 are such that when reflector members 18*a* and 18*b* are mounted on the ribs against the contour edge surfaces 60*a* and 60*b* in the case of an irradiator having shutters 28*a,b*, or against the contour edge surfaces 60*a*, 66'*a* and 60*b*, 66'*b* in the case of a non-shuttered irradiator, upper marginal edges of the reflector members extend into the recesses 74*a* and 74*b*. The edge surfaces 72*a,b* are configured such that with a narrow reflector member 76 mounted on the ribs 16 through mounting tabs 70, air gaps are created between the laterally opposite marginal edges of the reflector member 76 and the corresponding marginal edges of the reflector members 18*a,b* inserted into the recesses 74*a,b*. The reflector member 76 cooperates with the air gaps to cause a cooling medium, such as air from fan 38, to pass downwardly through the air gaps over the inner surfaces of the reflector members 18*a,b* simultaneously with flowing over the opposite outer surfaces of reflector member 18*a,b*. Because the aluminum ribs 16 are relatively thin, and have relatively high heat transfer characteristics, air flowing over the opposite inner and outer surfaces of the reflector members 18*a,b* removes heat from the reflector members resulting from non-reflected light energy. The narrow reflector member 76 funnels the cooling air over the inner reflector surfaces of the reflector members 18*a,b* and substantially prevents the cooling air from impinging the light energy source in a manner to adversely affect the light energy emitted.

Figure 15:
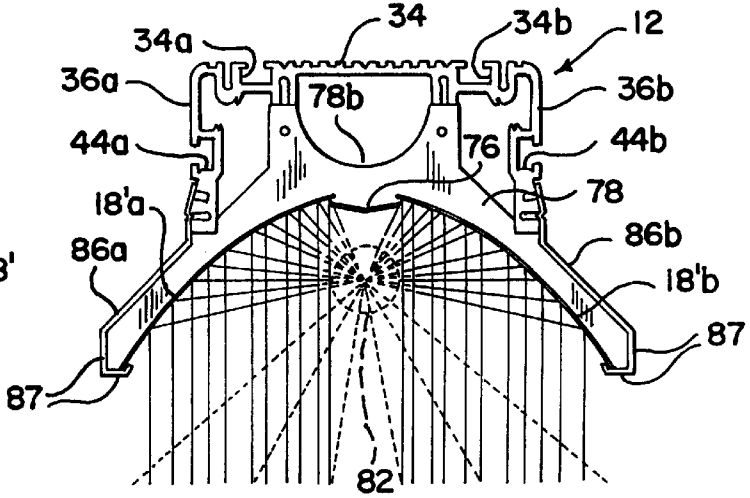
FIG. 15 is a transverse sectional view similar to FIG. 9 but schematically illustrating energy reflected from parabolic reflector surfaces from a light energy source supported in parallel relation to the parabolic reflector surfaces.
Figure 14:
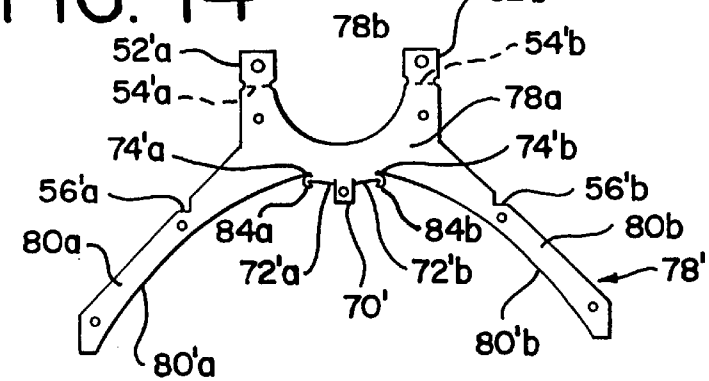
FIG. 14 is a detail view of a rib blank for forming a parabolic profile rib adapted for mounting within the housing illustrated in FIG. 7 and having an alternative arrangement for mounting a reflector member intermediate the mutually opposed parabolic profile surfaces on the rib.

FIG. 14 illustrates a metallic rib blank 78' from which a rib may be made for use with the housing 12 to make an irradiator having parabolic light energy reflector surfaces for creating a nonfocused optical configuration, as shown schematically in FIG. 15. The rib blank 78' is similar to the elliptical reflector support rib blank 16' of FIG. 10, and primed reference numerals in FIG. 14 represent structure generally similar to structure indicated by corresponding non-primed reference numerals in FIG. 10. To this end, the rib blank 78' has a pair of laterally spaced leg portions 80*a* and 80*b* having mutually opposed contour edge surfaces 80'*a* and 80'*b*, respectively, symmetrical about a center axis of rib blank 78' dividing the rib blank in two symmetrical halves. The contour edge surfaces 80'*a* and 80'*b* are formed as segments of a generally parabolic profile so that light energy rays emitted from a light energy source, such as an elongated UV lamp shown schematically at 82 in FIG. 15, which impinge reflector surfaces on reflector members 18'*a* and 18'*b* when mounted against the parabolic edge surfaces 80'*a* and 80'*b* are reflected as parallel rays.

The converging ends of the leg portions 80*a,b* are connected through a web portion 78*a* having mounting tabs 52'*a*, 52'*b* bendable about bend lines 54'*a,b* to facilitate mounting within the recess 14 of housing 12. A concave recess 78*b* is formed between the mounting tabs 52'*a,b* to enable flow of air along the length of a plenum chamber created beneath the housing wall 34 when a plurality of ribs 78 are mounted in spaced relation within housing recess 14. Notches 56'*a* and 56'*b* are formed in the rib blank 78' to engage inner corner edges 58*a* and 58*b* on housing 12.

A pair of reflector mounting ears 84*a* and 84*b* are formed at the outer ends of the angled surfaces 72'*a,b* on laterally opposite sides of a reflector mounting tab 70'. The retaining ears 84*a,b* are adapted to receive longitudinal marginal edges of a relatively narrow shallow V-shaped reflector member 76 when the mounting tab 70' is bent at 90° its base. To this end, the retaining ear 84*a* projects outwardly from and generally normal to edge surface 72'*a*, while the retaining ear 84*b* is hook-shaped as shown. In this manner, a longitudinal marginal edge of reflector member 76 can be inserted into the hook-shaped recess defined by ear 84*b*, and the opposite longitudinal marginal edge can be moved freely to engage edge surface 72'*a*. By reversing or alternating the orientation of adjacent ribs 78 when mounted within housing recess 14 so that the hook-shaped ears 84*b* alternate with the right-angle ears 84*a* between adjacent ribs, the reflector member 76 will be firmly retained against the edge surfaces 72'*a* and 72'*b* by the hook-shaped ears 84*b* cooperating with opposite marginal edges of the reflector member. This arrangement similarly creates air gaps between the longitudinal marginal edges of reflector member 76 and the corresponding longitudinal marginal edges of reflector members 18*a* and 18*b* inserted into the recesses 74'*a* and 74'*b*. The air gaps enable cooling air to be circulated over opposite surfaces of the reflector members 18*a* and 18*b* by fan 38 and exhausted through air orifices formed along the lower ends of light guards 86*a* and 86*b*, such as indicated at 87 in FIG. 15. The orifices 87 also enable air to be drawn upwardly over the reflector members. The light guards 86*a,b* are secured to the side walls 36*a,b* of housing 12 and support the lower marginal edges of the reflector members 18*a,b*. It will be appreciated that the reflector member 76 may be secured to the bent mounting tabs 70' on the ribs 78 as described in respect to the elliptical profile ribs. 16. Similarly, the elliptical profile ribs 16 may have reflector retaining ears formed thereon similar to the retaining ears 84*a,b*. In many applications, use of the reflector retaining ears to support the reflector member 76 enables the mounting tabs 70 and 70' to be eliminated.

Figure 12:
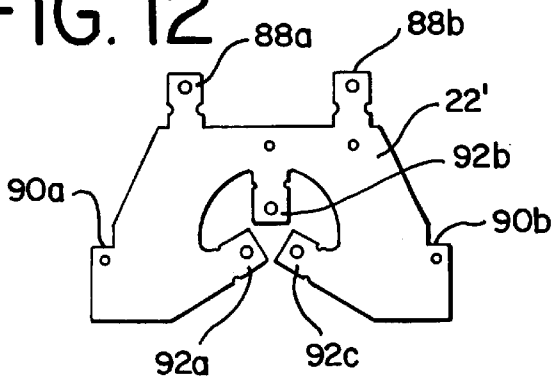
FIG. 12 is a detail view of a blank from which one embodiment of a lamp holder may be formed.

The lamp support plates 22*a* and 22*b* are identical and may be made from a relatively thin metallic material, such as 1/16 inch stainless steel, formed in a blank as indicated at 22' in FIG. 12. The blank 22' has a pair of mounting tabs 88*a* and 88*b* that are bent to 90° angles and enable mounting of the lamp support plate within the housing recess 14 by fastener screws inserted through the mounting tabs into the screw mounting slots 42*a,b*. Each lamp support plate 22 has a pair of right angle recesses 90*a* and 90*b* formed to abut the corner edges 58*a* and 58*b* on the housing 12 similar to the ribs 16. The lamp support plate blank 22' has three lamp mounting tabs 92*a–c* formed thereon which are bent to 90° angles and have threaded holes therethrough to receive lamp mounting and positioning screws 94 as illustrated in FIG. 3.

When mounted within the housing recess 14, the ribs 16 and lamp support plates 22*a,b* may be selectively positioned along the length of the housing in parallel axially aligned relation by mounting screws inserted into the elongated screw mounting slots 42*a,b*. An elongated light energy lamp, such as indicated schematically at 82 in FIG. 15 and comprising a suitable wattage lamp capable of emitting radiation preferably in the intensity range of approximately 185–1200 nanometers, may have its ends supported by the lamp support plates 22*a,b* through the mounting screws 94. The elongated lamp may be adjusted relative to the rib contour surfaces 60*a,b* and the reflector member 74 through adjustment of the screws 94.

Figure 19A:
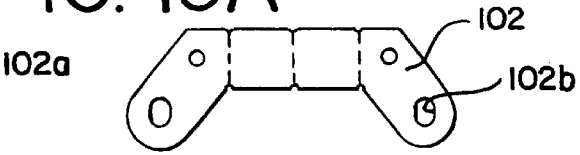
FIGS. 19A and 19B illustrate a blank for forming the lamp locating bracket utilized in the light source support arrangement of FIG. 18.
Figure 19B:
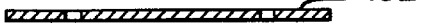
Figure 20:
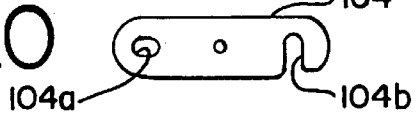
FIG. 20 is a plan view of the retaining bracket as employed in the lamp support arrangement of FIG. 18.
Figure 18:
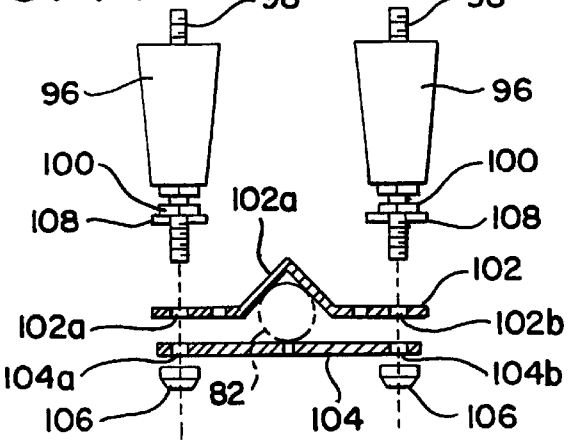
FIG. 18 is an exploded elevational view illustrating an alternative arrangement for supporting a light source within the housing recess so that the light source is substantially parallel to and intermediate the light energy reflector surfaces.

FIGS. 18–20 illustrate an alternative arrangement for supporting a light energy source between the reflector members in either the shuttered or non-shuttered embodiments of the irradiator in accordance with the present invention. The alternative light energy source support arrangement includes a pair of frustoconical ceramic insulator standoffs 96 each of which is supported on a threaded shaft 98 that extends outwardly from opposite ends of the corresponding standoff. A suitable retaining nut 100 maintains each standoff at a position along its corresponding support shaft 98 so that upward ends of the threaded shafts may be threaded into the screw slots 42*a* and 42*b* of the housing 12 to support the standoffs within the housing recess 14. With a pair of standoffs 96 mounted within the housing recess 14 so that the longitudinal axes of the two standoffs lie in a plane transverse to the longitudinal axis of the housing 12, a light energy lamp locating bracket 102 is mounted on the lower ends of the threaded shafts 98 and has a generally V-shaped central portion 102*a* configured to receive an end of an elongated light energy lamp, such as a UV lamp indicated in phantom at 82. The bracket 102 may be made from a sheet metal blank as illustrated in FIGS. 19A,B and has openings 102*b* to receive the shafts 98 after forming the V-shaped central portion 102*a* from the planar blank.

A planar retaining bracket 104, having a plan configuration as illustrated in FIG. 20, has an opening 104*a* and an open ended slot 104*b* which enable the retainer bracket to be pivotally mounted on one of the shafts 98 through the opening 104*a*. The retainer bracket is pivotable about the shaft 98 from a position enabling free access to the V-shaped portion 102*a* of bracket 102 to a position wherein the slot 104*b* receives the opposite threaded shaft 98. A pair of thumbnuts 106 retain the brackets 102 and 104 on the lower ends of the shafts 98 to clamp an end of a lamp end 82 within the V-shaped recess 102*a*. One or more washers or spacers 106 may be mounted on the shafts 98 between the nuts 100 and the bracket 102 to enable vertical adjustment of bracket 102 and thereby the lamp 82 relative to the reflector members to obtain a desired focus point of the light energy lamp. A particular feature of the lamp mounting arrangement illustrated in FIGS. 18–20 is the ability to readily support elongated light energy bulbs or lamps having either ceramic or metallic ends with each end of the lamp being supported in a similar lamp support arrangement.

In a non-shuttered embodiment of an irradiator as thus far described, at least one and preferable two elliptical profile ribs 16 or parabolic profile ribs 78 and either a pair of the lamp support plates 22*a,b* or lamp support brackets 102, 104 are mounted within the housing recess 14 with the ribs positioned between and parallel to the lamp supports. A pair of elongated relatively thin metallic reflector members 18*a* and 18*b*, such as 20 gauge polished aluminum or aluminum or other suitable metal having a dichroic filter coating on the reflective surface, are mounted against the contour edge surfaces 60*a*, 66*a* and 60*b*, 66*b* of the ribs 16 or against the contour edges 80'*a,b* of ribs 78 so as to have a corresponding cross sectional profile, such as a partial parabolic or elliptical profile curvature. The reflector members are retained against the rib contour surfaces by inserting longitudinal marginal edges of the reflectors within the recesses 74*a,b* or 74'*a,b* formed at the innermost ends of the contour surfaces. In the embodiment illustrated in FIG. 9, the lower longitudinal marginal edge of each reflector member 18*a,b* extends downwardly below the corresponding housing side wall 36*a* or 36*b* and is retained by a flange 110*a* formed on a generally L-shaped wall extension 110 attached to the outer surface of the corresponding housing wall 36*a* or 36*b* through screws 112 secured in the screw mounting slots 48*a* and 48*b*.

Figure 17:
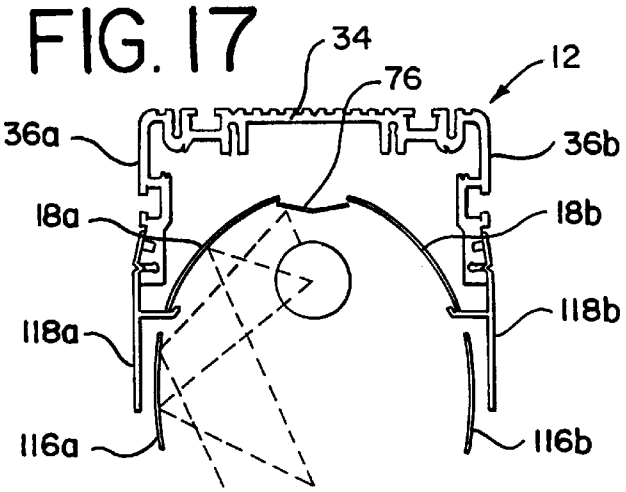
FIG. 17 is a transverse sectional view schematically illustrating an embodiment of the invention employing shutters to establish the lowermost portions of the elliptical profile reflector members.

In a shuttered embodiment of the irradiator, the elliptical profile ribs 16 are modified to remove the lower portions of the laterally opposed legs 66*a,b* as by severing at the fracture lines 68*a* and 68*b*, and the modified ribs are mounted within the housing recess 14 as aforedescribed. Referring to FIGS. 1 and 2, taken in conjunction with FIGS. 16 and 17, the shutters 28*a* and 28*b* are hingedly mounted on end plates fixed to the opposite ends of housing 12, such as end plates 26 shown in FIGS. 3–5. The shutters 28*a,b* may be made of extruded aluminum and are hinged to the end plates by suitable hinge pins inserted into holes 26*b* in the end plates. Each shutter 28*a*, 28*b* has mutually opposed recesses or slots 114*a* and 114*b* (FIG. 16) formed along its longitudinal marginal edges to receive a reflector member, such as indicated schematically at 116*a* and 116*b* in FIG. 17. The reflector members 116*a,b* are similar to the reflector members 18*a,b* and compliment the corresponding elliptical profile reflector members 18*a,b* so as to assist in irradiating focused light energy from the lamp source when the shutters are in open positions. As shown in FIG. 17, a pair of side wall extensions 118*a* and 118*b* are secured to the housing side walls 36*a,b* to support the lower free ends of reflector members 18*a,b* when mounted on ribs 16. The side wall extensions 118*a,b* may extend below the housing sidewalls externally of the shutters 28*a,b* if desired.

As aforedescribed, it is desirable that a transverse reflector plate 24 be mounted within the housing recess 14 between each of the lamp support plates 22*a,b* or lamp supports 102, 104 and the next adjacent rib 16 so that the reflector plates cooperate with the reflector members to optimize radiation of light energy from the irradiator. A typical reflector plate 24 is illustrated in FIG. 11 and is made from a suitable reflector material such as 20 gauge polished aluminum. Each reflector plate 24 is configured to enable it to be inserted into the housing recess 14 and attached to an associated one of the lamp support plates 22*a* or 22*b* or to a rib 16 through spacers and mounting screws (not shown) inserted through suitable aligned holes formed in the ribs 16, lamp support plates 22*a,b* and reflector plates. The reflector plates have elongated recesses 24*a* formed therein that open outwardly of the open side of the housing recess 14 and are sized to enable insertion of a light energy lamp, such as the UV lamp 82, internally of the ribs and reflector plates when mounting the ends of the lamp within the lamp support plates 22*a,b* or between the support brackets 102 and 104.

Figure 5:
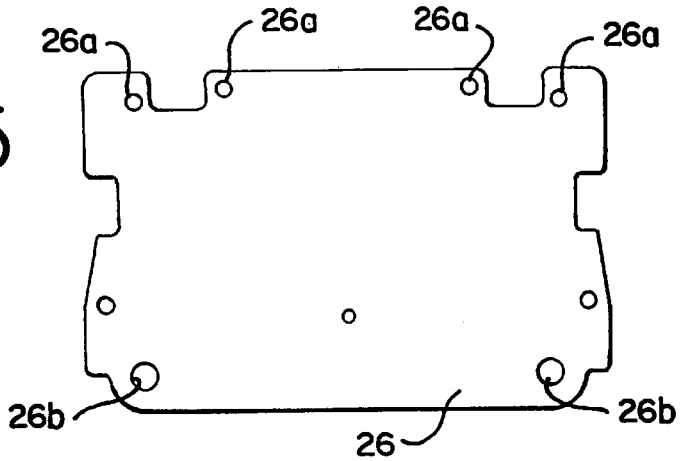
FIG. 5 is a detail view of the end plate shown in FIG. 4.
Figure 16:
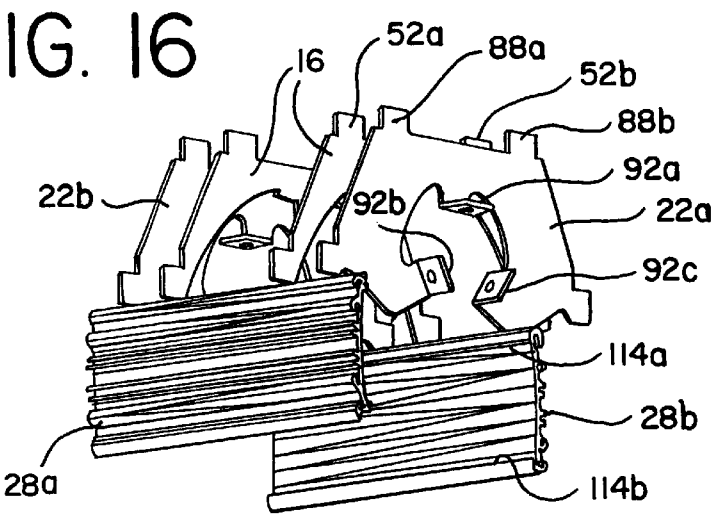
FIG. 16 is a perspective view similar to FIG. 8 but illustrating the use of shutters in conjunction with reflector surface support ribs having elliptical profiles.

After mounting a desired number of ribs 16, a pair of lamp supports, and preferably a pair of reflector plates 24 within the housing recess 14, end plates 26 are secured to the forward and rearward ends of the housing 12. When utilizing shutters with the irradiator, such as shown in FIGS. 1, 2 and 16, end plates 26 as illustrated in FIG. 5 are secured to the opposite ends of the housing 12 by fastener screws inserted through screw holes 26*a* in the end plates and into the ends of the screw slots 34*c*, 34*d*, 42*a* and 42*b* in the housing simultaneously with inserting the shutter hinge pins into the holes 26*b* in the end plates 26.

Figure 13:
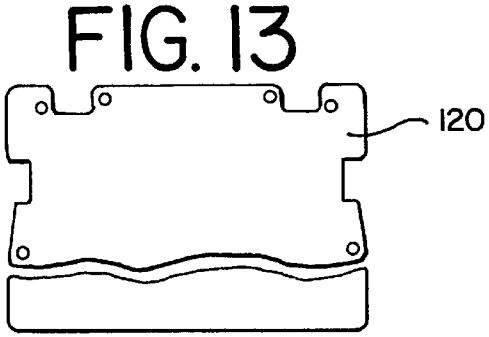
FIG. 13 is a detail view of an end plate as employed in the assembly of FIG. 7.

The non-shuttered embodiment of the irradiator also employs end plates mounted on the opposite ends of the housing 12, one of which is indicated at 120 in FIGS. 7, 8 and 13. The end plates 120 are mounted on the housing in similar fashion to the aforedescribed end plates 26.

It will be appreciated that in addition to the irradiator 10 assembled with the various components as aforedescribed, the irradiator will include conventional means (not shown) to enable connection of the UV lamp and ventilation fan 38 to suitable power sources. As described, to facilitate ventilation and cooling of the irradiator during operation, the longitudinal marginal edges of the reflector member 76 are spaced from the adjacent reflector members 18*a* and 18*b* to create air gaps enabling air to be blown or drawn over the opposite surfaces of the reflector members by fan 38. The various thin aluminum reflector members enable rapid cooling of the irradiator.

Thus, in accordance with the present invention, a light energy irradiator is provided that significantly reduces the heat problems associated with prior irradiators. This is accomplished through the employment of relatively thin reflector members that have high heat transfer properties and are supported by relatively thin profiled ribs to provide either focused or nonfocused optical configurations. The ribs are configured to facilitate passage of cooling air over opposite surfaces of the profiled reflector members without significant cooling of a light energy source supported between the reflector members. The various components may be readily manufactured at low cost and easily assembled and disassembled without requiring special tooling or highly skilled technicians. The reflector member support ribs may be readily interchanged to provide elliptical, semi-circular or parabolic reflective surfaces to achieve focused or nonfocused optical configurations.

While preferred embodiments of the present have been illustrated and described, it will be understood that changes and modifications may be made therein without departing from the invention in its broader aspects. Various features of the invention are defined in the following claims.

I claim:

1. An irradiator comprising, in combination, an elongated housing having a longitudinal axis and defining an interior recess opening outwardly along a longitudinal length of said housing, at least one generally planar rib supported within said recess in substantially transverse relation to the longitudinal axis of said housing, said rib defining a pair of laterally spaced substantially symmetrical contour surfaces having either generally parabolic or elliptical profiles, lamp holders supported within said recess for supporting a source of light energy intermediate said contour surfaces, and at least one reflector member disposed against each of said contour surfaces so as to define a light energy reflector surface having a profile established by the profile of the corresponding contour surface, said light reflective surfaces being operative to effect irradiation of energy from a source supported by said lamp holders.

2. An irradiator as defined in claim 1 wherein said elongated housing includes a base wall and a pair of laterally spaced side walls connected to lateral marginal edges of said base wall in substantially right angle relation thereto, said base wall and side walls defining said recess therebetween.

3. An irradiator as defined in claim 2 wherein said housing is made from extruded aluminum.

4. An irradiator as defined in claim 2 including a pair of generally L-shaped light guard members secured to said laterally spaced housing side walls, said light guard members cooperating with said rib to retain said reflector members against said contour surfaces of said rib.

5. An irradiator as defined in claim 1 including a plurality of said generally planar ribs supported within said recess in parallel spaced axially aligned relation, and including a pair of said reflector members each of which is disposed against corresponding contour surfaces on said ribs so as to extend longitudinally of the housing.

6. An irradiator as defined in claim 5 including a pair of end plates secured to opposite ends of said housing such that said ribs are supported within said recess between said end plates.

7. An irradiator as defined in claim 5 wherein each of said ribs has a pair of laterally spaced reflector mounting ears thereon intermediate said contour surfaces, and including a further elongated reflector supported by said mounting ears intermediate said contour surfaces so as to define a further light energy reflector surface.

8. An irradiator as defined in claim 7 wherein said further elongated reflector is spaced from said reflector members disposed against said contour surfaces so as to define air gaps therebetween enabling flow of cooling air over opposite surfaces of said profiled reflector members.

9. An irradiator as defined in claim 1 wherein said housing defines a base wall having a surface exposed to said recess, said ribs having mounting tabs thereon enabling attachment of said ribs to said exposed housing surface.

10. An irradiator as defined in claim 9 wherein said base wall has a pair of longitudinal slots formed in said surface exposed to said recess, and including fasteners adapted for cooperation with said slots and said mounting tabs on said rib to releasably retain said rib in selected position along said base wall.

11. An irradiator as defined in claim 1 wherein said housing has a base wall having a first surface exposed to said recess and a second surface defining an external surface of said housing, said second surface having at least one longitudinally extending channel formed therein to facilitate mounting of said housing on an external support fixture.

12. An irradiator as defined in claim 1 including a pair of shutters pivotally mounted on said housing and movable between a first closed position substantially preventing irradiation of energy from said recess, and a second open position enabling irradiation of energy from said recess.

13. An irradiator as defined in claim 12 wherein each of said shutters has an inner reflective surface cooperative with said reflector members disposed against said rib contour surfaces for effecting irradiation of energy from said recess when said shutters are in said open positions.

14. An irradiator as defined in claim 1 wherein said lamp holders are operative to support an elongated light energy lamp in substantially parallel relation to said reflector members, said lamp holders enabling adjustment of the lamp to vary the focal point of energy irradiated from elliptical profile reflector members.

15. An irradiator apparatus comprising, in combination, an elongated housing having a base wall and a pair of laterally spaced side walls connected to lateral marginal edges of said base wall in substantially right-angle relation thereto, said base and side walls defining an open sided recess extending longitudinally of said housing, a plurality of relatively thin ribs mounted within said recess in transverse relation to the longitudinal axis of said housing, said ribs having laterally opposed contour surfaces defining profile surfaces disposed in longitudinal alignment within said recess, at least one reflector member supported against each of said contour surfaces so that said reflector members have transverse profiles corresponding to said profile surfaces defined by said contour surfaces, said reflector members having laterally spaced marginal edges supported to enable air flow over opposite surfaces of said reflector members to effect heat transfer from said reflector members.

16. An irradiator as defined in claim 15 including a pair of reflector plates mounted within said recess in parallel and axially aligned relation with said ribs to define end boundaries of an irradiator chamber, and a pair of lamp holder assemblies mounted within said recess for supporting an elongated light energy source in substantially parallel relation to said reflector members.

17. An irradiator as defined in claim 15 wherein at least some of said ribs have reflector mounting ears thereon supporting a further reflector member intermediate said profiled reflector members, said further reflector member and said profiled reflector members defining air gaps therebetween enabling air flow over opposite surfaces of said profiled reflector members.

18. An irradiator as defined in claim 15 wherein said ribs and reflector plates have mounting tabs thereon adapted to be releasably secured to said base wall to enable selective spacing of said ribs and reflector plates along the length of said housing.

19. An irradiator as defined in claim 15 wherein said profile surfaces are formed as segments of parabolic or elliptical profile surfaces.

20. An irradiator comprising, in combination, an elongated housing defining an interior recess having a longitudinal axis and opening outwardly along a longitudinal length of said housing, at least one rib supported within said recess and having mutually opposed generally elliptical or parabolic profile edge surfaces symmetrical about a relation longitudinal median plane containing the longitudinal axis of said housing, at least one reflector member supported against each of said profile edge surfaces so that said reflector members have corresponding elliptical or parabolic transverse profiles and lie in laterally spaced relation symmetrical to the longitudinal axis of said recess, lamp holder means disposed within said recess for supporting a source of light energy intermediate said reflector members, said reflector members being operative to effect irradiation of energy from said light source when supported by said lamp holder means and being configured to enable air flow over opposite surfaces thereof to effect cooling of said reflector members without significantly cooling said source of light energy.

21. A rib for supporting a reflector member in an irradiator device, said rib comprising a relatively thin rigid member having a central axis and including a pair of laterally opposed leg portions generally symmetrical about said central axis, said leg portions having first ends interconnected to each other and having second ends disposed in spaced apart relation, said leg portions defining mutually opposed symmetrical profile edge surfaces each of which terminates adjacent the corresponding first end in a recess adapted to receive a marginal edge of a reflector member when disposed against the corresponding profile edge surface.

22. A rib as defined in claim 21 further including at least one mounting tab thereon enabling said rib to be secured to a support member in parallel relation to one or more similar ribs.

23. A rib as defined in claim 21 wherein said profile edge surfaces define segments of a parabolic contour.

24. A rib as defined in claim 21 wherein said profile edge surfaces define segments of an elliptical contour.

25. A rib as defined in claim 21 wherein said rigid member is generally planar and includes a reflector mounting tab intermediate said first ends of said profile edge surfaces, said reflector mounting tab being bendable to a position generally normal to the plane of said rigid member and adapted to support a reflector member intermediate said leg portions.

26. A rib as defined in claim 21 wherein said recesses in said first ends of leg portions are spaced apart, said rib having a pair of laterally spaced reflector mounting ears each of which is disposed generally adjacent one of said recesses in said leg portions, said reflector mounting ears being configured for supporting cooperation with marginal edges of a further discrete reflector member positioned generally between reflector members disposed against said profile edge surfaces.

27. A rib as defined in claim 26 wherein one of said pair of laterally spaced reflector mounting ears defines a hook-shaped recess, and wherein the other of said reflector mounting ears is configured to enable a marginal edge of a discrete reflector member to be freely inserted therein when an opposite marginal edge of said discrete reflector member is inserted into said hook-shaped recess.

28. A rib as defined in claim 27 wherein said reflector mounting ears are spaced from said recesses defined at said first ends of said leg portions such that an air gap is created between, on the one hand, the marginal edge of each reflector member inserted into one of said recesses defined at said first ends of said leg portions and, on the other hand, the corresponding marginal edge of a further discrete reflector member supported by said reflector mounting ears.

* * * * *